US009526941B2

(12) United States Patent
Wu

(10) Patent No.: US 9,526,941 B2
(45) Date of Patent: Dec. 27, 2016

(54) BARBELL

(71) Applicant: Azuni International Co., Ltd., Taichung (TW)

(72) Inventor: Li-Lan Wu, Taichung (TW)

(73) Assignee: AZUNI INTERNATIONAL CO., LTD., Taichung (TW)

( * ) Notice: Subject to any disclaimer, the term of this patent is extended or adjusted under 35 U.S.C. 154(b) by 0 days.

(21) Appl. No.: 14/656,146

(22) Filed: Mar. 12, 2015

(65) Prior Publication Data

US 2016/0228739 A1 Aug. 11, 2016

(30) Foreign Application Priority Data

Feb. 6, 2015 (TW) ..... 104104101 A

(51) Int. Cl.
*A63B 21/072* (2006.01)
*A63B 21/075* (2006.01)

(52) U.S. Cl.
CPC ..... *A63B 21/0728* (2013.01); *A63B 21/0724* (2013.01)

(58) Field of Classification Search
CPC ... A63B 1/0603; A63B 21/072; A63B 21/075; A63B 21/0602; A63B 21/0724; A63B 21/0004; A63B 21/0726; A63B 21/0728; A63B 21/00065; A63B 21/4043; A63B 21/06; A63B 21/0607; A63B 21/0601; A63B 21/0722
USPC ..... 482/92–94, 104–109
See application file for complete search history.

(56) References Cited

U.S. PATENT DOCUMENTS 2,509,810 A * 5/1950 Core, Jr. ..... A63B 15/00 16/42 T
3,311,374 A * 3/1967 Wittenberg ..... A63B 21/0602 482/106
3,756,597 A * 9/1973 Monti ..... A63B 21/0004 273/DIG. 6
4,029,312 A * 6/1977 Wright ..... A63B 21/0602 482/106
4,199,140 A * 4/1980 Ferretti ..... A63B 21/0728 222/210
4,854,575 A * 8/1989 Wilson ..... A63B 21/0602 482/108
4,863,158 A * 9/1989 Tassone ..... A63B 21/0004 482/106
5,033,740 A * 7/1991 Schwartz ..... A63B 21/0722 482/105
5,135,455 A * 8/1992 King ..... A63B 21/0726 482/105

(Continued)

*Primary Examiner* — Loan H Thanh
*Assistant Examiner* — Andrew S Lo
(74) *Attorney, Agent, or Firm* — Muncy, Geissler, Olds & Lowe, P.C.

(57) ABSTRACT

A barbell is provided. The barbell includes a main body and two holding elements. The main body is elongated and hollow to enclose a receiving room. The receiving room is adapted for being filled with fluid or solid. The main body defines a longitudinal direction. The main body is formed with at least one positioning recess on the outer surface thereof. Each holding element is movable sleeved onto the main body. The holding element has a positioning element which is selectively abutted against the positioning recess to position the holding element on the main body. The holding element further has a holding portion for holding.

8 Claims, 8 Drawing Sheets

(56) References Cited

U.S. PATENT DOCUMENTS 5,203,753 A * 4/1993 Rothhammer ..... A63B 21/072 411/55
5,325,997 A * 7/1994 Washington ..... F41H 9/10 222/175
5,417,635 A * 5/1995 Sell ..... A63B 21/065 482/105
5,441,471 A * 8/1995 Passer ..... A63B 21/0602 482/106
5,445,587 A * 8/1995 Brown ..... A63B 21/0602 482/108
5,820,531 A * 10/1998 Choi ..... A63B 21/072 482/110
6,599,222 B2 * 7/2003 Wince ..... A63B 21/0724 482/106
7,048,678 B2 * 5/2006 Harms ..... A63B 21/0728 482/107
7,758,477 B2 * 7/2010 Prenatt ..... A63B 21/0603 215/379
8,038,585 B1 * 10/2011 Brown, Jr. ..... A63B 21/0004 482/108
8,231,511 B2 7/2012 Dalcourt
8,617,036 B2 12/2013 Chen
8,672,815 B1 3/2014 Springer
8,870,717 B2 * 10/2014 Pfitzer ..... A63B 21/015 482/106
8,888,665 B2 * 11/2014 Pfitzer ..... A63B 21/0602 482/104
2005/0187075 A1 * 8/2005 Bellamy ..... A63B 21/0004 482/93
2006/0079383 A1 * 4/2006 Hermans ..... A63B 21/0603 482/109
2011/0263394 A1 * 10/2011 Viselman ..... A63B 21/00061 482/93
2011/0287904 A1 * 11/2011 Morris ..... A63B 21/0602 482/93
2012/0088639 A1 * 4/2012 Dalcourt ..... A63B 21/0602 482/93
2012/0283072 A1 * 11/2012 Jones ..... A63B 21/0602 482/93
2012/0309596 A1 * 12/2012 Kennedy ..... A63B 21/0602 482/93
2013/0072357 A1 * 3/2013 Galvan ..... A63B 69/34 482/83
2013/0267390 A1 * 10/2013 Warren ..... A63B 21/0602 482/93
2013/0310229 A1 * 11/2013 Kovach ..... A63B 21/0004 482/106
2014/0179495 A1 * 6/2014 Payan ..... A63B 21/0724 482/110
2015/0051053 A1 * 2/2015 Conen ..... A63B 21/0603 482/108
2015/0148201 A1 * 5/2015 Schmidt ..... A63B 21/0724 482/107

* cited by examiner

BARBELL

BACKGROUND OF THE INVENTION

Field of the Invention

The present invention relates to a barbell.

Description of the Prior Art

A conventional barbell disclosed in U.S. Pat. No. 8,617,036 includes a shaft and counter weights disposed on two ends of the shaft. A user can hold and grasp the central portion of the shaft to lift the barbell for training. However, it is laborious that the user must grasp the shaft horizontally. Besides, to alternate the weight of lifting, the counter weights have to be detached and exchanged.

U.S. Pat. No. 8,672,815 further disclosed a new barbell including a shaft having an annular portion wherein holding rods are disposed on a central portion of the annular portion. Thereby, it is easier to lift the barbell because the user can grasp the shaft vertically. However, counter weights still have to be detached and exchanged when the weight of lifting is to be alternated. Besides, to adjust the positions where the user grasp, the two connected shafts have to be adjusted. Thus, it is difficult to make adjustments, and the range of adjusting is limited.

U.S. Pat. No. 8,231,511 disclosed a multi-ways barbell including a hollow shaft formed with through holes for grasping. However, the positions of grasping are unable to be adjusted, and the weight of lifting is also unable to be alternated.

SUMMARY OF THE INVENTION

The main object of the present invention is to provide a barbell having a main body which is adapted for being filled with objects and holding elements which are detachable so that weight and position of holding can be adjusted.

To achieve the above and other objects, a barbell of the present invention includes a main body and two holding elements.

The main body is pipe-shaped and encloses a receiving room. The receiving room is adapted for being filled with fluid or solid. The main body defines a longitudinal direction. The main body has at least one positioning portion on an outer surface thereof. Each holding element has a hollow central portion to be sleeved onto the main body movably. The holding element has a positioning element which selectively abuts against the positioning portion to make the holding element be positioned to the main body. The holding element further has at least one holding portion for holding.

Thereby, the weight of the barbell can be adjusted by selectively filling the receiving room with water, sand, or others. In addition, the position of the holding elements with respect to the main body can be alternated because of the positioning elements which selectively abut against the positioning recesses.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
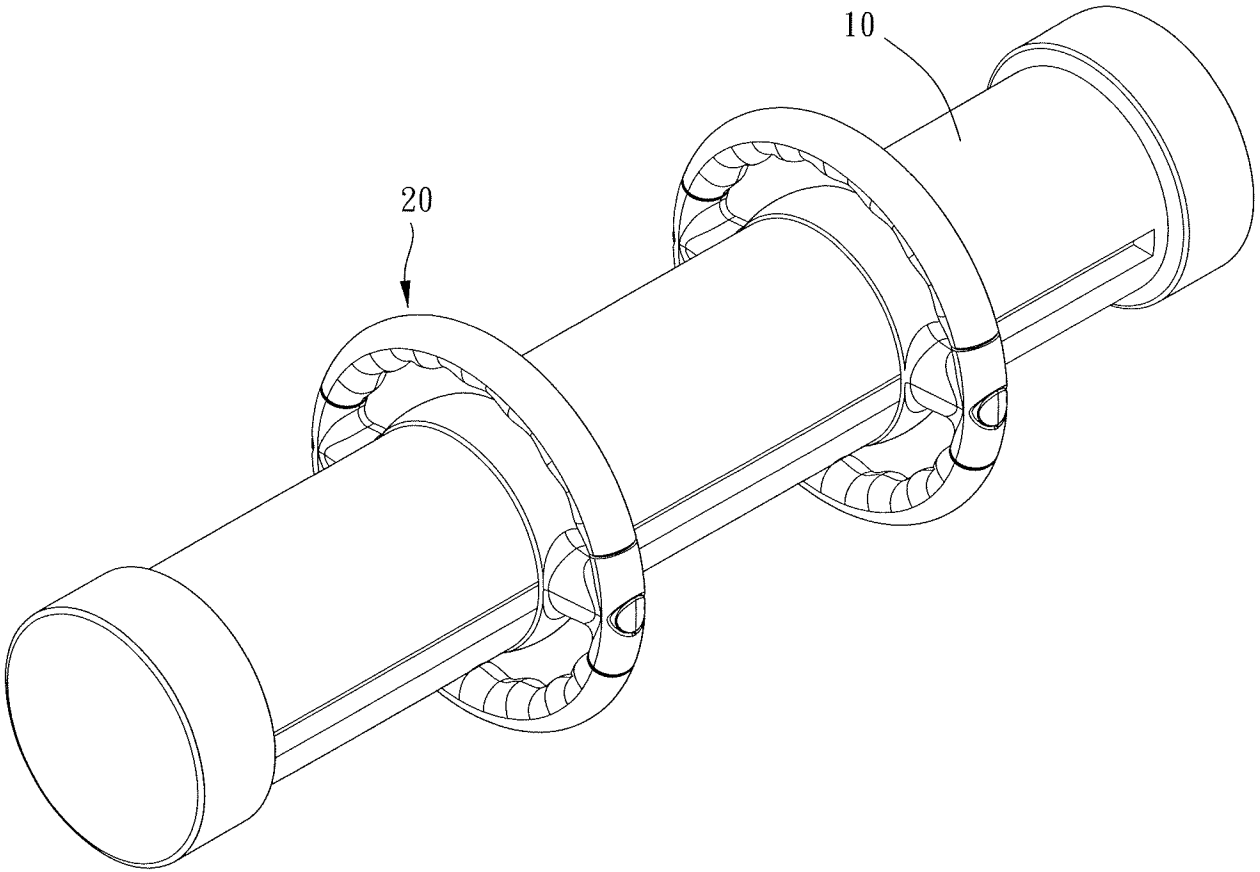
FIG. 1 is a stereogram of the present invention.
Figure 2:
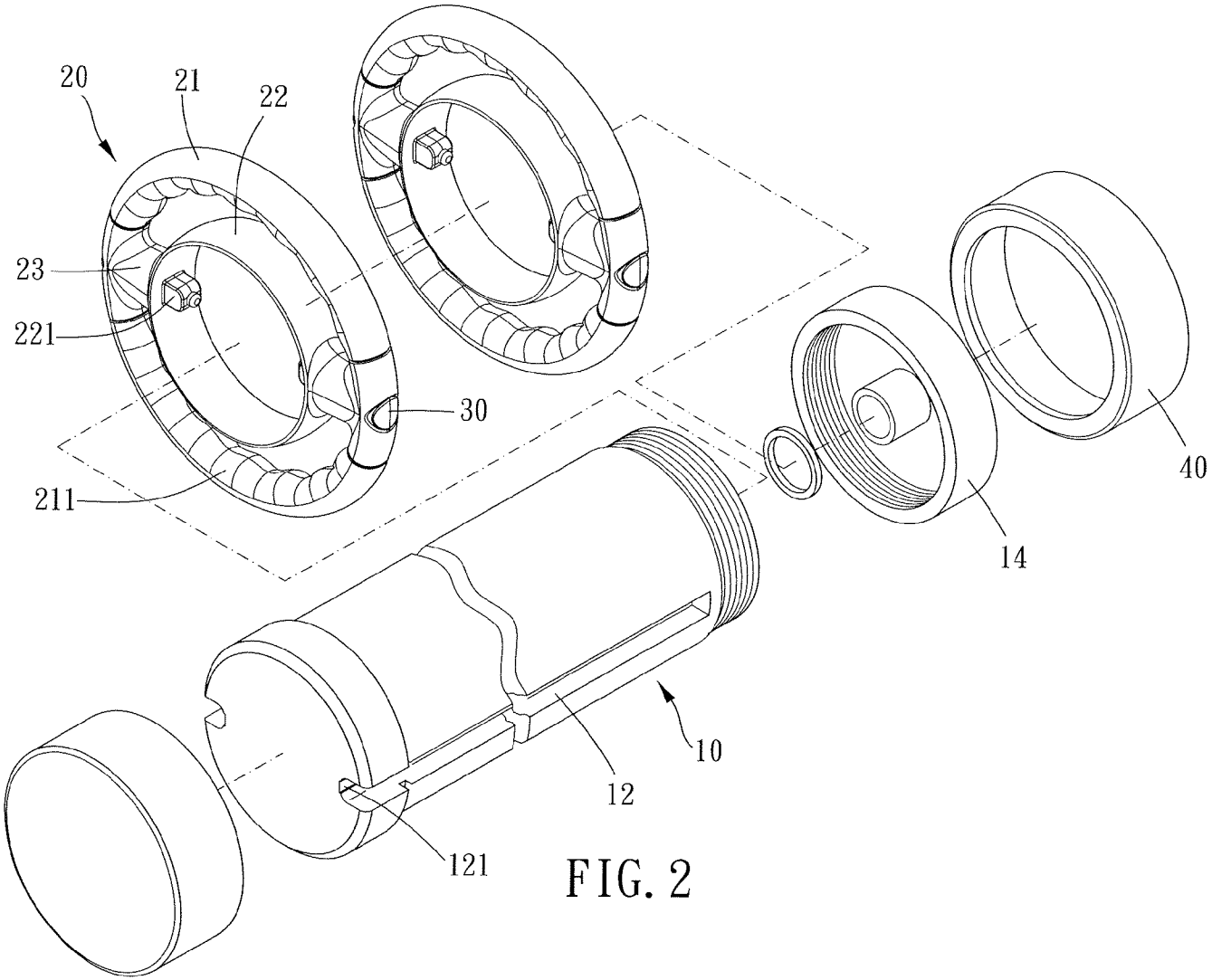
FIG. 2 is a breakdown drawing of the present invention.

Please refer to FIG. 1 to FIG. 6 and FIGS. 3A, 5A, and 6A, the barbell of the present invention includes a main body 10 and two holding elements 20.

The main body 10 is pipe-shaped or column-shaped and encloses a receiving room 11. The receiving room 11 is adapted for being filled with fluid or solid to modify the weight of the main body 10. The main body 10 defines a longitudinal direction. The main body 10 has at least one positioning portion on an outer surface thereof. Preferably, the positioning portion is a positioning recess. In the present embodiment, the main body 10 is formed with an elongated groove 12 extending along the longitudinal direction of the main body 10. The positioning recess is a sliding groove 121 formed on a bottom of the elongated groove 12 and extending along the longitudinal direction of the main body 10. The main body 10 is formed with a filling opening 13 at an end thereof along the longitudinal direction, and a cover 14 is disposed on the main body 10 to close the filling opening 13. Preferably, the main body 10 further includes two cushion elements 40 which are arranged at two opposite ends of the main body 10 along the longitudinal direction thereof. Specifically, the cushion elements 40 are made of rubber in order to provide a cushion when the main body 10 falls.

Each holding element 20 has a hollow central portion to be sleeved onto the main body 10 movably. The holding element 20 has a positioning element 30 which selectively abuts against the positioning recess to make the holding element 20 be positioned to the main body 10. The holding element 20 further has at least one holding portion for holding. In the present embodiment, each holding element 20 includes an inner ring 22, an outer ring 21, at least one engaging portion 23, and the positioning element 30. The inner ring 22 has an external diameter smaller than an internal diameter of the outer ring 21 and is located at a center of the outer ring 21 so that the inner ring 22 and the outer ring 21 are arranged in interval. The holding portion is formed on the outer ring 21. The inner ring 22 is sleeved onto the main body 10. The engaging portion 23 connects the inner ring 22 and the outer ring 21 and is located therebetween. The positioning element 30 is movably received in the engaging portion 23 to be movable between a first position and a second position. The holding element 20 is formed with a protruding portion 221 on an inner fringe of the inner ring 22 toward a central axis of the holding element 20. The protruding portion 221 is slidably received in the elongated groove 12. When the positioning element 30 is located at the first position, an end of the positioning element 30 is protruded above an inner fringe of the inner ring 22 to abut against the positioning recess (elongated groove 121). When the positioning element 30 is located at the second position, the positioning element 30 is hidden in the engaging portion 23 so as not to abut against the positioning recess (elongated groove 121) so that the holding element 20 is movable along the longitudinal direction of the main body 10. Preferably, each holding element 20 is made of plastic, and at least part of an outer surface of the outer ring 21 (especially the holding portion) is covered with an elastic layer 211. In the present embodiment, the elastic layer 211 is made of TPR (thermoplastic rubber).

Figure 3:
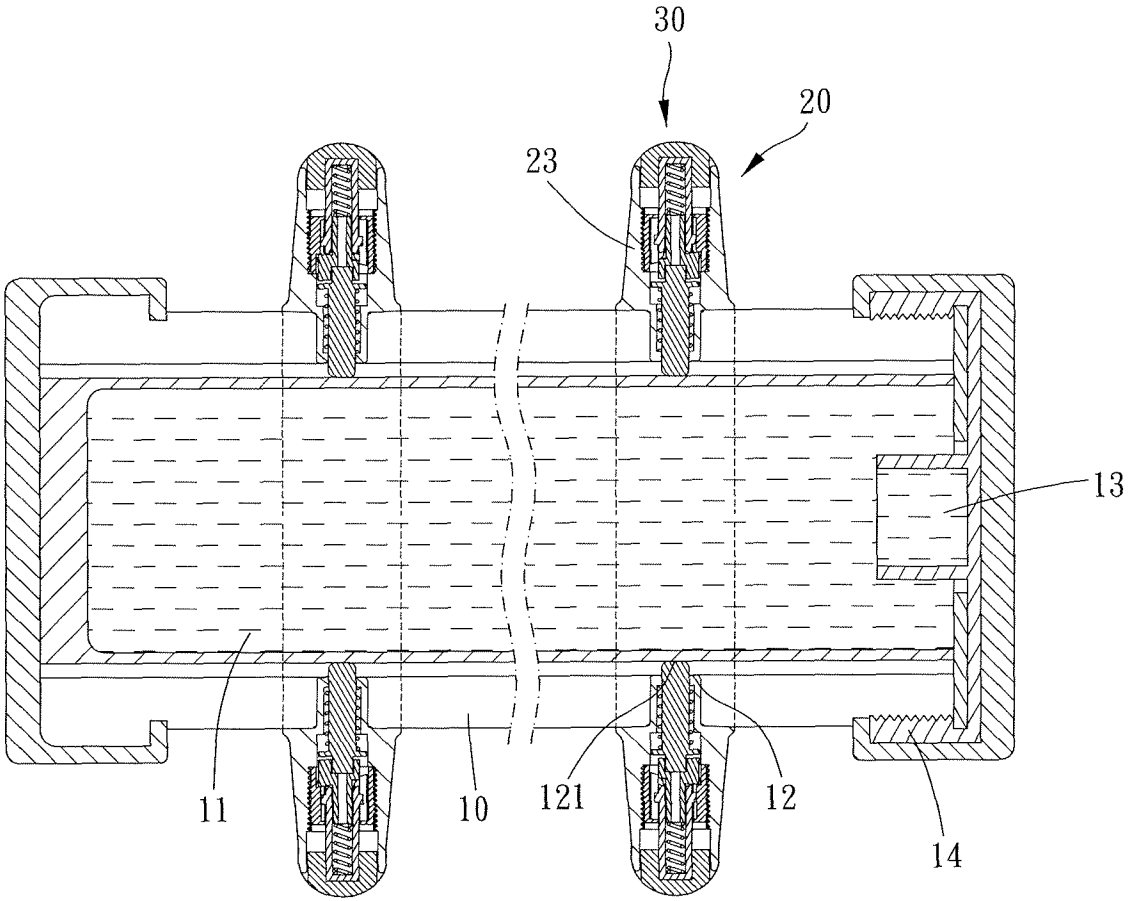
FIG. 3 is a profile of the present invention when a positioning element is located at a first position.
Figure 3A:
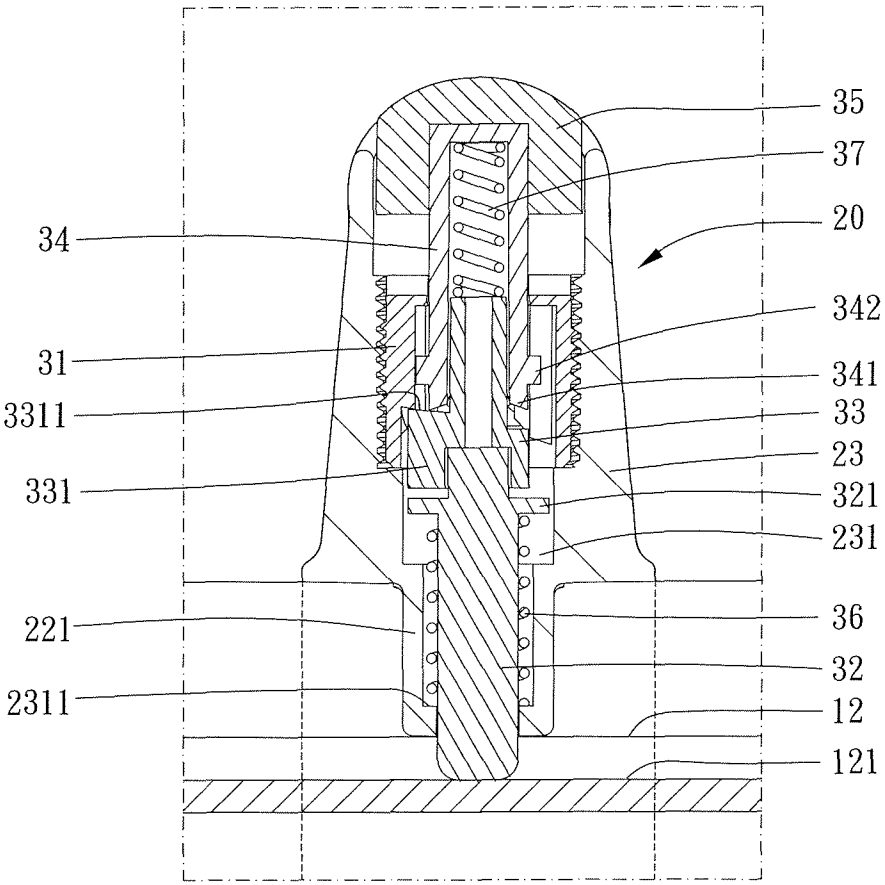
FIG. 3A is a partial enlargement of FIG. 3.
Figure 4:
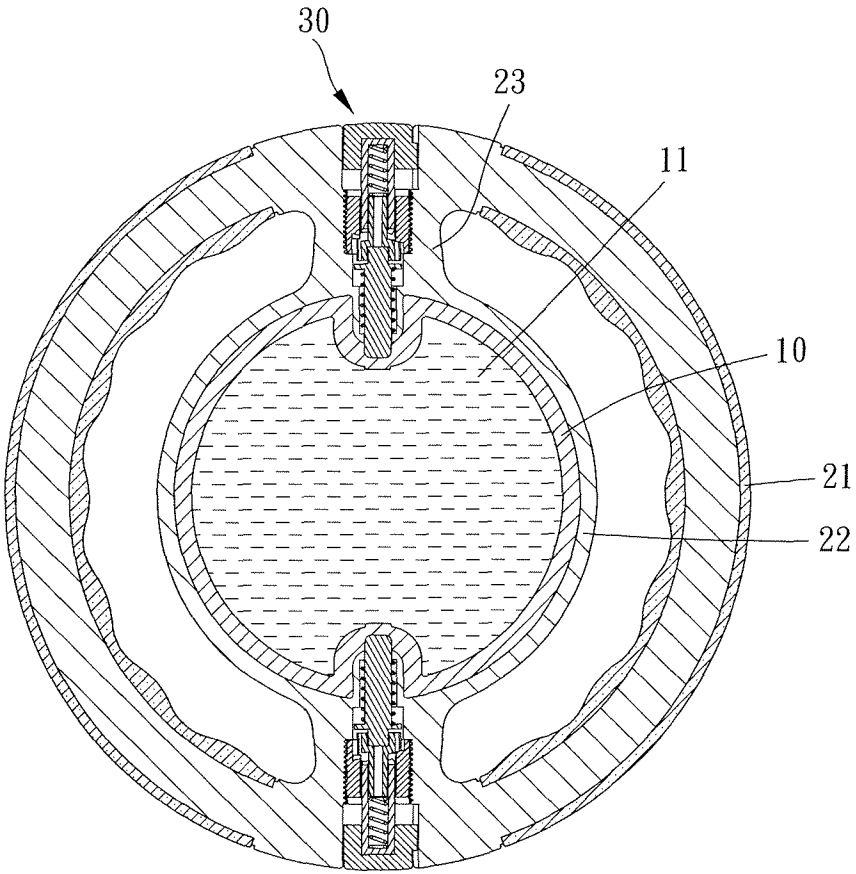
FIG. 4 is a profile of the present invention at another angle.
Figures 5, 5A:
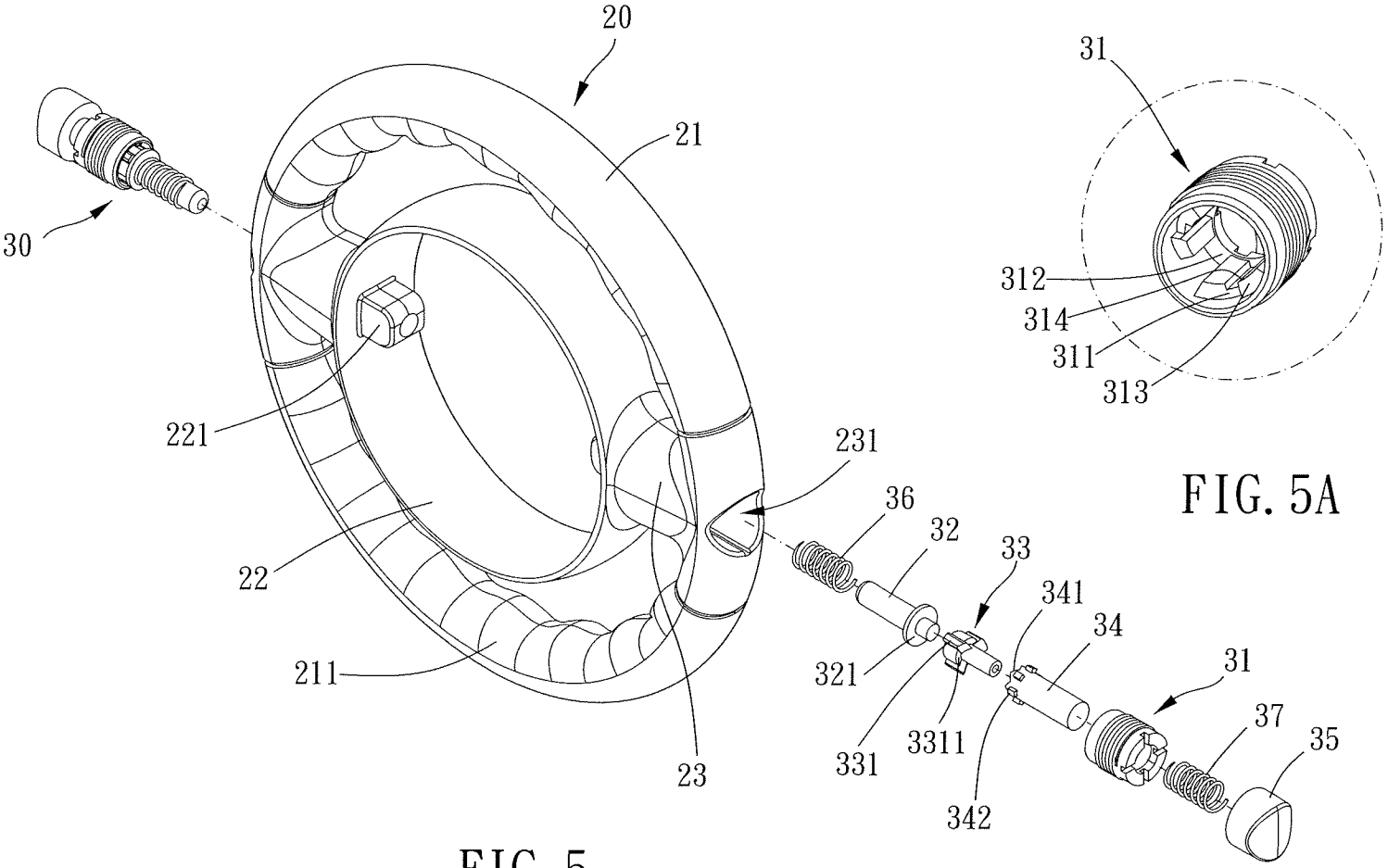
FIG. 5 is a breakdown drawing of a holding element of the present invention.
FIG. 5A is a stereogram of a shell of the present invention at another angle.
Figure 6:
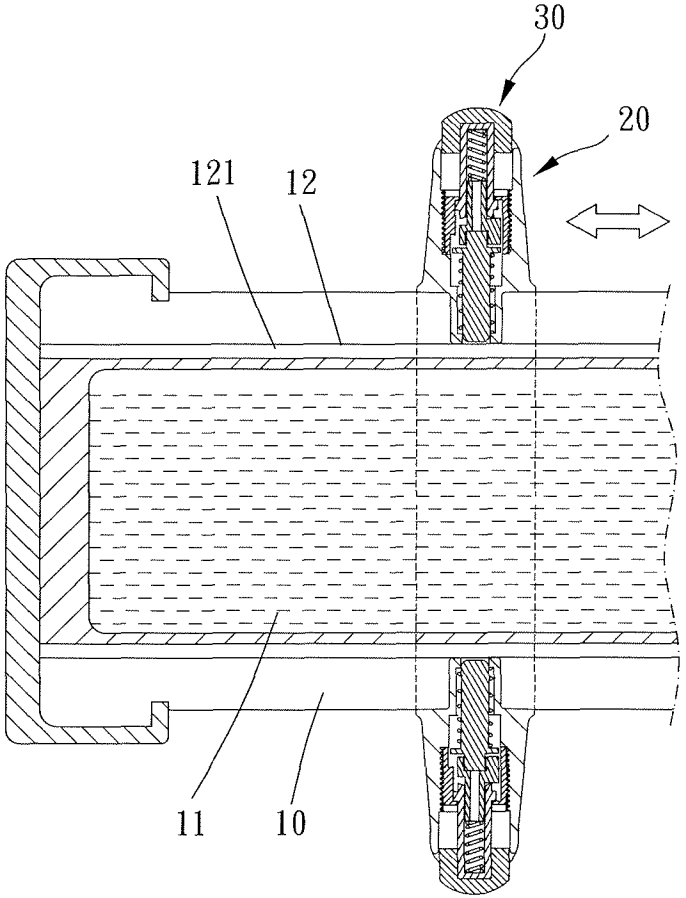
FIG. 6 is a profile of the present invention when a positioning element is located at a second position.
Figure 6A:
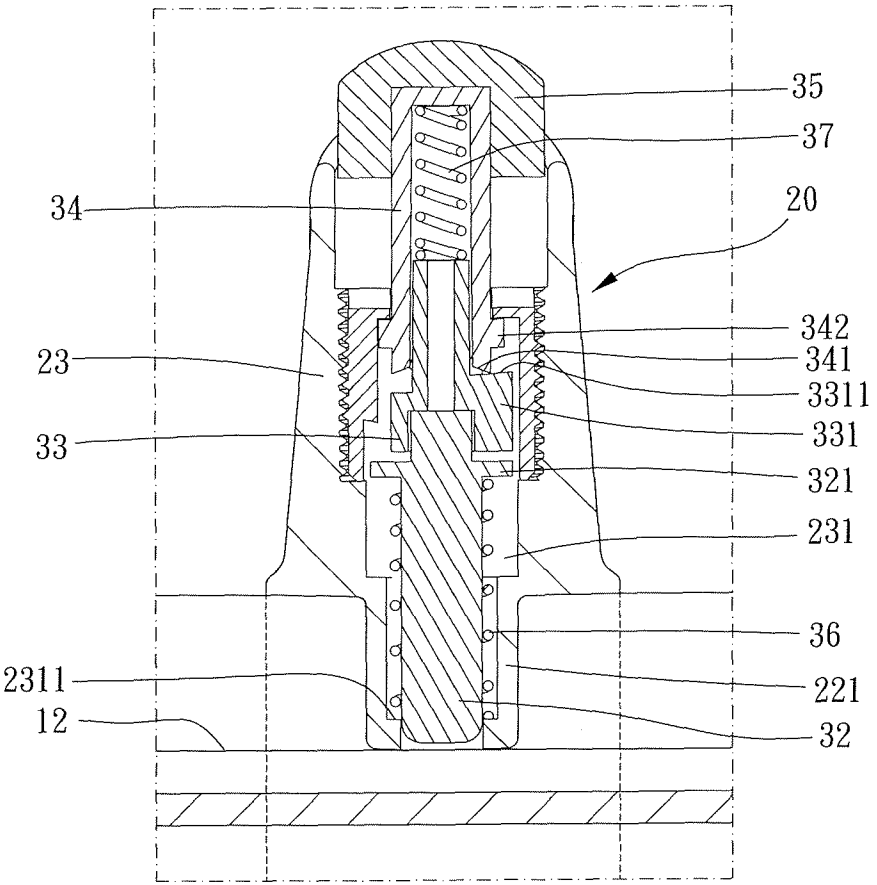
FIG. 6A is a partial enlargement of FIG. 6.

In the present embodiment, a channel 231 is formed in the engaging portion 23. The channel 231 penetrates the holding element 20 from the inner fringe of the inner ring 22 to an outer fringe of the outer ring 21. The channel 231 defines an end thereof closer to the outer fringe of the outer ring 21 as a first end. The channel 231 defines an end thereof closer to the inner fringe of the inner ring 22 as a second end. The second end of the channel has a reduced internal diameter to form a stepped face 2311. The positioning element 30 includes a shell 31, an abutting element 32, a rotary element 33, a toothed element 34, a pressing element 35, a first elastic element 36, and a second elastic element 37. The shell 31 is received in the channel 231 and is formed with plural shorter grooves 311 and longer grooves 312 arranged alternatively. Each of the shorter grooves 311 and the longer grooves 312 extends along an extension direction of the channel 231. An end of each shorter groove 311 closer to the first end and an end of each longer groove 312 closer to the first end are dead ends. An end of each shorter groove 311 closer to the second end and an end of each longer groove 312 closer to the second end have openings. A first inclined face 313 is formed between openings of any two adjacent shorter groove 311 and longer groove 312. The dead end of each shorter groove 311 is closer to the second end of the channel 231 than the dead end of each longer groove 312 is. The abutting element 32 is formed with an annular flange 321. The first elastic element 36 is sleeved onto the abutting element 32 and is located between the annular flange 321 and the stepped face 2311 of the channel 231. An end of the toothed element 34 closer to the second end has a plurality of teeth 341. The toothed element 34 is slidable in the shell 31 along the extension direction of the channel 231 but is non-rotatable with respect to the shell 31. More specifically, the shell 31 is formed with at least one receiving groove 314 on the inner wall thereof. The receiving groove 314 extends along the extension direction of the channel 231. The toothed element 34 is formed with at least one protrusion 342 slidably disposed in the receiving groove 314. The rotary element 33 is arranged between the abutting element 32 and the toothed element 34 and is rotatable with respect to the abutting element 32 and the toothed element 34. The rotary element 33 is formed with a plurality of longitudinal ribs 331 on an outer wall thereof wherein each longitudinal rib 331 extends along the extension direction of the channel 231. An end of each longitudinal rib 331 facing the toothed element 34 is formed with a second inclined face 3311. Each longitudinal rib 331 is slidably disposed in one of the shorter grooves 311 and the longer grooves 312. The second inclined face 3311 of each longitudinal rib 331 is selectively abutted against by the teeth 341 of the toothed element 34. The pressing element 35 is arranged at the first end of the channel 231 and is linked-up with the toothed element 34. The second elastic element 37 is arranged in the toothed element 34 and is located between the toothed element 34 and the rotary element 33. When the pressing element 35 is pressed to push the toothed element 34 toward the first end, each longitudinal rib 331 is pushed to leave the shorter groove 311 or the longer groove 312 so that the second inclined face 3311 slides along the first inclined face 313 to make the rotary element 33 rotate to make the longitudinal rib 331 enter an adjacent longer groove 312 or shorter groove 311. When the longitudinal ribs 331 are located in the shorter grooves 311, the abutting element 32 protrudes above the inner fringe of the inner ring 22, as shown in FIGS. 3 and 3A. When the longitudinal ribs 331 are located in the longer grooves 312, the abutting element 32 is received in the channel 231 and does not protrude above the inner fringe of the inner ring 311, as shown in FIGS. 6 and 6A.

In other possible embodiments of the present invention, the main body can have plural positioning recesses arranged along the longitudinal directions of the main body in interval. The positioning element of each holding element selectively abuts against one of the positioning recesses to alternate the position of the holding element with respect to the main body.

In use, a user can hold and grasp the holding portions of the two holding elements with both hands to lift the barbell of the present invention for training. To alternate the distance between the two holding elements, the user can press the pressing element 35 of each positioning element 30 to make the adjusting element 32 move inward, and then the user can move the holding elements 20 along the main body 10. When the holding elements 20 are moved to the desired positions, the holding elements 29 can be positioned to the main body 10 again by pressing the pressing element 35 again to make the abutting element 32 abuts against the elongated groove 121.

Besides, the main body 10 has a receiving room 11 which is able to be filled with water, sand, or other objects. Thus, the weight of the main body 10 can be adjusted easily.

In conclusion, the barbell of the present invention has a main body which is able to be filled with objects to adjust the weight of the main body, and the holding elements can be moved or positioned selectively due to the positioning elements. In addition, the holding elements can also serve as counter weights.

What is claimed is:

1. A barbell, including:

a main body, being cylindrical shaped and enclosing a receiving room, the receiving room being adapted for being filled with fluid or solid, the main body defining a longitudinal direction, the main body having at least one positioning portion on an outer surface thereof; two holding elements, each holding element having a hollow central portion to be sleeved onto the main body and being slidable on the main body along the longitudinal direction of the main body in order to alter a distance between the two holding elements, the holding element having a positioning element which selectively abuts against the positioning portion to make the holding element be positioned to the main body at a desirable position of the main body, the holding element further having at least one holding portion for holding, wherein the positioning portion is a positioning recess, the positioning recess is a sliding groove extending along the longitudinal direction of the main body, the main body is formed with an elongated groove on the outer surface thereof, the elongated groove extends along the longitudinal direction of the main body, the sliding groove is formed on a bottom of the elongated groove, each holding element is formed with a protruding portion on an inner fringe thereof toward a central axis of the holding element, the protruding portion is slidably received in the elongated groove.

2. The barbell of claim 1, wherein the main body is formed with a filling opening at an end along the longitudinal direction of the main body, the main body has a cover arranged on the filling opening to close the filling opening.

3. The barbell of claim 1, wherein each holding element includes an inner ring, an outer ring, at least one engaging portion, and the positioning element, the inner ring has an external diameter smaller than an internal diameter of the outer ring and is located at a center of the outer ring so that the inner ring and the outer ring are arranged in interval, the holding portion is formed on the outer ring, the inner ring is sleeved onto the main body, the engaging portion connects the inner ring and the outer ring and is located therebetween, the positioning element is movably received in the engaging portion to be movable between a first position and a second position, an end of the positioning element is protruded above an inner fringe of the inner ring to abut against the positioning recess when the positioning element is located at the first position, the positioning element is hidden in the engaging portion so as not to abut against the positioning recess when the positioning element is located at the second position so that the holding element is movable along the longitudinal direction of the main body.

4. The barbell of claim 3, wherein a channel is formed in the engaging portion, the channel penetrates the holding element from the inner fringe of the inner ring to an outer fringe of the outer ring, the channel defines an end thereof closer to the outer fringe of the outer ring as a first end, the channel defines an end thereof closer to the inner fringe of the inner ring as a second end, the second end of the channel has a reduced internal diameter to form a stepped face, the positioning element includes a shell, an abutting element, a rotary element, a toothed element, a pressing element, a first elastic element, and a second elastic element, the shell is received in the channel and is formed with plural shorter grooves and longer grooves arranged alternatively, each of the shorter grooves and the longer grooves extends along an extension direction of the channel, an end of each shorter groove closer to the first end and an end of each longer groove closer to the first end are dead ends, an end of each shorter groove closer to the second end and an end of each longer groove closer to the second end have openings, a first inclined face is formed between openings of any two adjacent shorter groove and longer groove, the dead end of each shorter groove is closer to the second end of the channel than the dead end of each longer groove is, the abutting element is formed with an annular flange, the first elastic element is sleeved onto the abutting element and is located between the annular flange and the stepped face of the channel, an end of the toothed element closer to the second end has a plurality of teeth, the toothed element is slidable in the shell along the extension direction of the channel but is non-rotatable with respect to the shell, the rotary element is arranged between the abutting element and the toothed element and is rotatable with respect to the abutting element and the toothed element, the rotary element is formed with a plurality of longitudinal ribs on an outer wall thereof wherein each longitudinal rib extends along the extension direction of the channel, an end of each longitudinal rib facing the toothed element is formed with a second inclined face, each longitudinal rib is slidably disposed in one of the shorter grooves and the longer grooves, the second inclined face of each longitudinal rib is selectively abutted against by the teeth of the toothed element, the pressing element is arranged at the first end of the channel and is linked-up with the toothed element, the second elastic element is arranged in the toothed element and is located between the toothed element and the rotary element, each longitudinal rib is pushed to leave the shorter groove or the longer groove so that the second inclined face slides along the first inclined face to make the rotary element rotate to make the longitudinal rib enter an adjacent longer groove or shorter groove when the pressing element is pressed to push the toothed element toward the first end, the abutting element protrudes above the inner fringe of the inner ring when the longitudinal ribs are located in the shorter grooves, the abutting element is received in the channel and does not protrude above the inner fringe of the inner ring when the longitudinal ribs are located in the longer grooves.

5. The barbell of claim 3, wherein each holding element is made of plastic, at least part of a surface of the outer ring is covered with an elastic layer which is made of TPR (thermoplastic rubber).

6. The barbell of claim 1, further including two cushion elements arranged at two opposite ends of the main body along the longitudinal direction thereof.

7. The barbell of claim 6, wherein each cushion element is made of rubber.

8. The barbell of claim 1, wherein the main body is formed with at least two positioning recesses, each positioning recess located at opposite ends of the main body along a radial direction, each holding element has at least two the positioning elements, each positioning element located at opposite ends of a respective holding element along a radial direction thereof, the at least two positioning elements correspond to the at least two positioning recesses.

* * * * *